US010024547B2

(12) United States Patent
Johnson et al.

(10) Patent No.: US 10,024,547 B2
(45) Date of Patent: Jul. 17, 2018

(54) COOLING SYSTEM FOR AN OVEN APPLIANCE

(71) Applicant: Haier US Appliance Solutions, Inc., Wilmington, DE (US)

(72) Inventors: Eric Scott Johnson, Louisville, KY (US); Aashish Ashokrao Saraf, Hyderabad (IN); Brandon John Bucholz, Chattanooga, TN (US); Katherine Michelle Jansen, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 90 days.

(21) Appl. No.: 15/216,771

(22) Filed: Jul. 22, 2016

(65) Prior Publication Data

US 2018/0023817 A1 Jan. 25, 2018

(51) Int. Cl.
*F24C 1/00* (2006.01)
*F24C 15/00* (2006.01)
*F24C 15/32* (2006.01)

(52) U.S. Cl.
CPC ..... *F24C 15/006* (2013.01); *F24C 15/322* (2013.01)

(58) Field of Classification Search
CPC ..... F24C 15/006; F24C 15/322
USPC ..... 126/198, 193
See application file for complete search history.

(56) References Cited

U.S. PATENT DOCUMENTS

| | | | | |
|---|---|---|---|---|
| 3,889,100 | A * | 6/1975 | Dills | F24C 15/006 126/198 |
| 6,772,752 | B1 * | 8/2004 | Boyer | F24C 7/082 126/21 A |
| 7,296,565 | B2 * | 11/2007 | Kim | F24C 15/006 126/193 |
| 7,368,684 | B2 * | 5/2008 | Kim | F24C 15/006 126/198 |
| 7,954,485 | B2 | 6/2011 | Cadima et al. | |
| 8,039,775 | B2 | 10/2011 | Venezia et al. | |
| 2015/0369491 | A1 | 12/2015 | Estrella et al. | |

* cited by examiner

*Primary Examiner* — Avinash Savani
(74) *Attorney, Agent, or Firm* — Dority & Manning, P.A.

(57) ABSTRACT

A cooling system for an oven appliance is provided. The oven appliance includes an insulated chamber positioned within a cabinet such that a plurality of air flow passageways are defined therebetween. A control panel is positioned at a top, front of the oven appliance and defines an electronics chamber which is in fluid communication with a side air flow passageway. An exhaust duct is positioned between the insulated chamber and the cabinet and is placed in fluid communication with the electronics chamber. An exhaust fan is positioned within the duct and is configured for drawing cooling air through the side air flow passageway, into the electronics chamber, and through the exhaust duct to an outlet where it is exhausted from the oven appliance.

20 Claims, 7 Drawing Sheets

COOLING SYSTEM FOR AN OVEN APPLIANCE

FIELD OF THE INVENTION

The present disclosure relates generally to an oven appliance, or more specifically, to an improved cooling system for an oven appliance.

BACKGROUND OF THE INVENTION

Oven appliances generally include a cabinet and an insulated cooking chamber disposed therein for receipt of food items for cooking. Heating elements are positioned within the cooking chamber to provide heat to food items located therein. The heating elements can include a bake heating element positioned at a bottom of the cooking chamber and/or a broil heating element positioned at a top of the cooking chamber. Oven appliances may also include a convection heating assembly, which may include a convection heating element and fan or other mechanism for creating a flow of heated air within the cooking chamber.

During operation of such oven appliances, one or more heating elements may be energized to heat the cooking chamber to a selected cooking temperature. Oven appliances require features for managing the thermal energy generated by the various heating elements. For example, conventional oven appliances define an air plenum between the cabinet and the insulated cooking chamber which houses the appliance controller, heating element junctions, and other electronics that require cooling. In addition, side panels and other surfaces of oven appliances often require significant cooling to meet regulatory standards.

Therefore, such oven appliances include cooling systems for managing the flow of heated air and regulating component temperatures. For example, a fan may be positioned within the oven appliance to continuously draw out heated air within the air plenum and replenish it with cooler ambient air, thereby cooling the oven electronics and the cabinet housing them.

However, conventional cooling systems draw air from a single inlet location, e.g., from a back of the oven appliance. In this manner, the mass flow rate of air exiting oven appliance may be larger proximate the back of the oven appliance relative to the front of the appliance. Notably, the back of the oven appliance typically needs the least cooling, whereas the front of the oven appliance typically houses most of the control electronics, experiences the highest temperatures, and requires the most cooling.

Accordingly, an oven appliance that provides features for improved thermal management would be useful. More particularly, a cooling system for an oven appliance that draws cool air from the control panel and the side panels of the oven appliance would be especially beneficial.

BRIEF DESCRIPTION OF THE INVENTION

The present subject matter provides a cooling system for an oven appliance. The oven appliance includes an insulated chamber positioned within a cabinet such that a plurality of air flow passageways are defined therebetween. A control panel is positioned at a top, front of the oven appliance and defines an electronics chamber which is in fluid communication with a side air flow passageway. An exhaust duct is positioned between the insulated chamber and the cabinet and is placed in fluid communication with the electronics chamber. An exhaust fan is positioned within the duct and is configured for drawing cooling air through the side air flow passageway, into the electronics chamber, and through the exhaust duct to an outlet where it is exhausted from the oven appliance. Additional aspects and advantages of the invention will be set forth in part in the following description, may be apparent from the description, or may be learned through practice of the invention.

In one exemplary embodiment, a cooking appliance defining a vertical direction, a lateral direction, and a transverse direction is provided. The cooking appliance includes a cabinet, a control panel positioned at a top, front corner of the cabinet, the control panel defining an electronics chamber, and an insulated cooking chamber positioned within the cabinet. An air flow plenum is defined between the cabinet and the insulated cooking chamber. A duct is positioned on a top of the insulated cooking chamber and extends along the transverse direction between an inlet and an exhaust port, the duct defining an exhaust passage in fluid communication with the air flow plenum. A fan is positioned in fluid communication with the duct and is configured for drawing air from the air flow plenum through the electronics chamber and discharging it out of the exhaust port.

In another exemplary embodiment, a cooling system for an oven appliance is provided. The oven appliance includes an insulated cooking chamber positioned within a cabinet and defines a vertical direction, a lateral direction, and a transverse direction. The cooling system includes side air flow passageways positioned adjacent lateral sides of the insulated cooking chamber, the side air flow passageways being defined between the insulated cooking chamber and the cabinet. An electronics chamber is defined by a control panel of the oven appliance, the electronics chamber being in fluid communication with the side air flow passageways. A fan is positioned in fluid communication with the electronics chamber for urging air from the side air flow passageways, into the electronics chamber, through the inlet into the exhaust passage, and out of the exhaust port.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
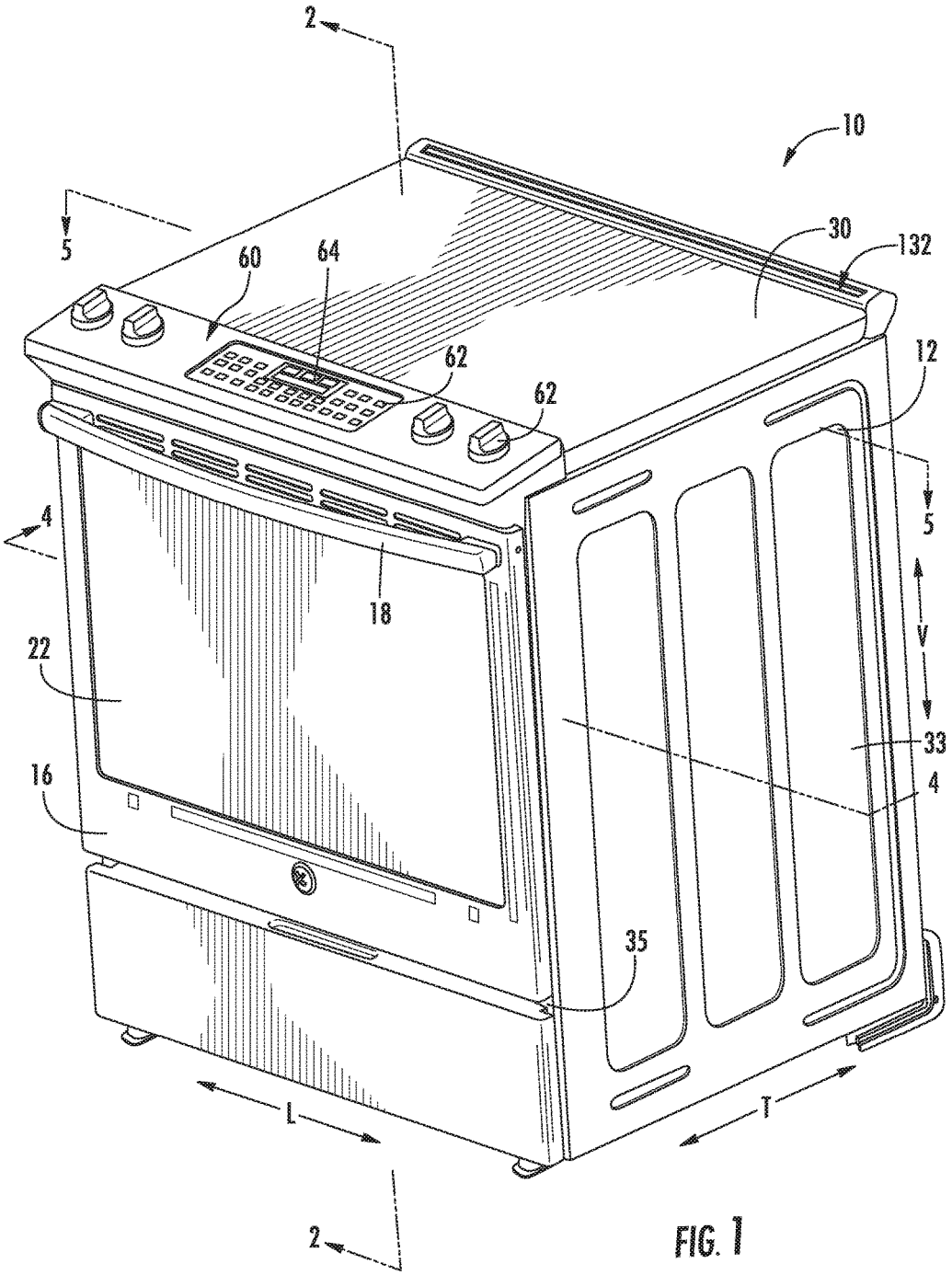
FIG. 1 provides a perspective view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
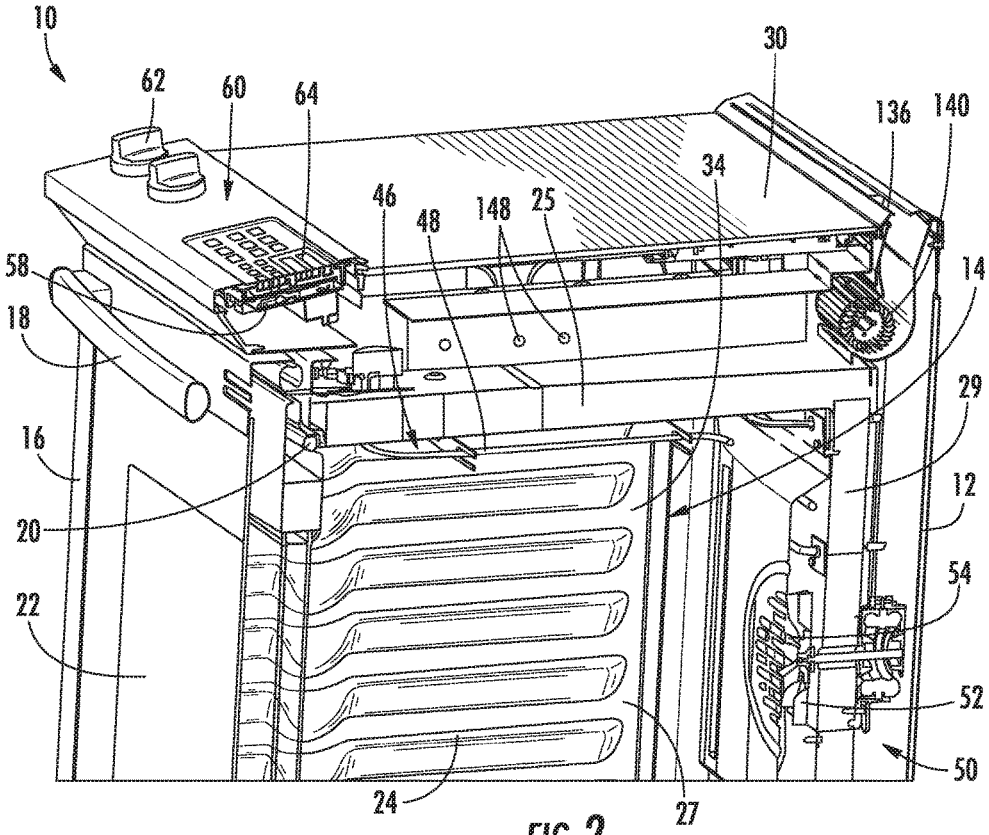
FIG. 2 provides a perspective sectional view of the exemplary oven appliance of FIG. 1 taken along the Line 2-2 of FIG. 1.

FIGS. 1 and 2 depict an exemplary oven appliance 10 that may be configured in accordance with aspects of the present disclosure. FIG. 1 provides a perspective view of oven appliance 10 according to an exemplary embodiment of the present subject matter. FIG. 2 provides a cross sectional view of oven appliance 10 taken along the 2-2 line of FIG. 1. For the particular embodiment of FIGS. 1 and 2, oven appliance 10 defines a vertical direction V, a lateral direction L and a transverse direction T. The vertical, lateral and transverse directions are mutually perpendicular and form an orthogonal direction system. As will be understood by those skilled in the art, oven appliance 10 is provided by way of example only, and the present subject matter may be used in any suitable cooking appliance. Thus, the present subject matter may be used with other oven appliances having different configurations, such as wall ovens, electric ovens, gas ovens, microwave ovens, etc.

Oven appliance 10 includes a cabinet 12 with an insulated cooking chamber 14 disposed within cabinet 12. Insulated cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access insulated cooking chamber 14. For example, a user can pull on handle 18 to open or close door 16 and access insulated cooking chamber 14.

Oven appliance 10 can include a seal, e.g., gasket 20, between door 16 and cabinet 12 that assists with maintaining heat and cooking fumes within insulated cooking chamber 14 when door 16 is closed as shown. Door 16 may include a window 22, constructed for example from multiple parallel glass panes to provide for viewing the contents of insulated cooking chamber 14 when door 16 is closed and assist with insulating insulated cooking chamber 14. A baking rack (not shown) may be positioned in insulated cooking chamber 14 for the receipt of food items or utensils containing food items. The baking rack may be slidably received onto embossed ribs 24 or sliding rails such that the baking rack may be conveniently moved into and out of insulated cooking chamber 14 when door 16 is open.

Figure 4:
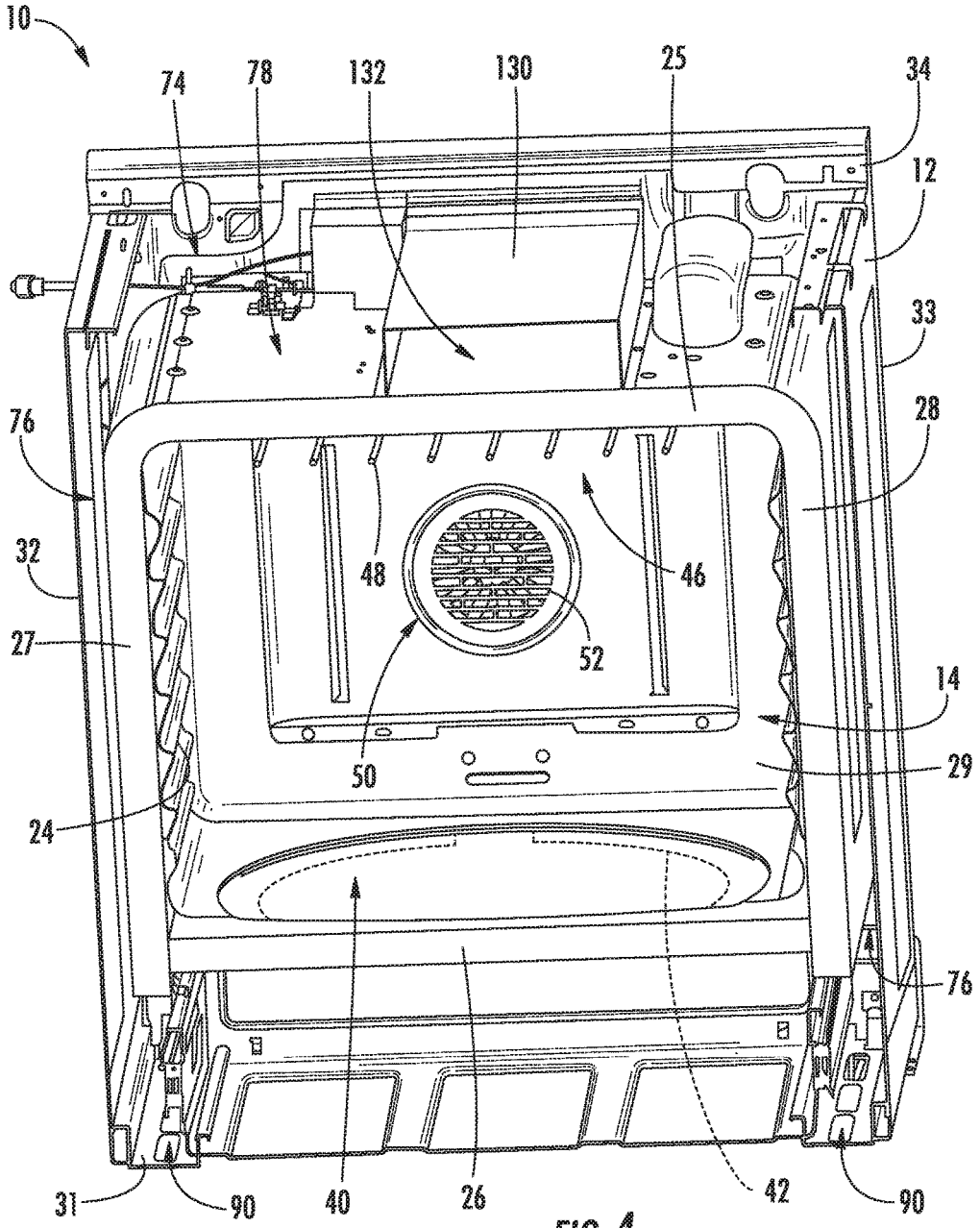
FIG. 4 provides a perspective sectional view of the exemplary oven appliance of FIG. 1 taken along the Line 4-4 of FIG. 1.
Figure 5:
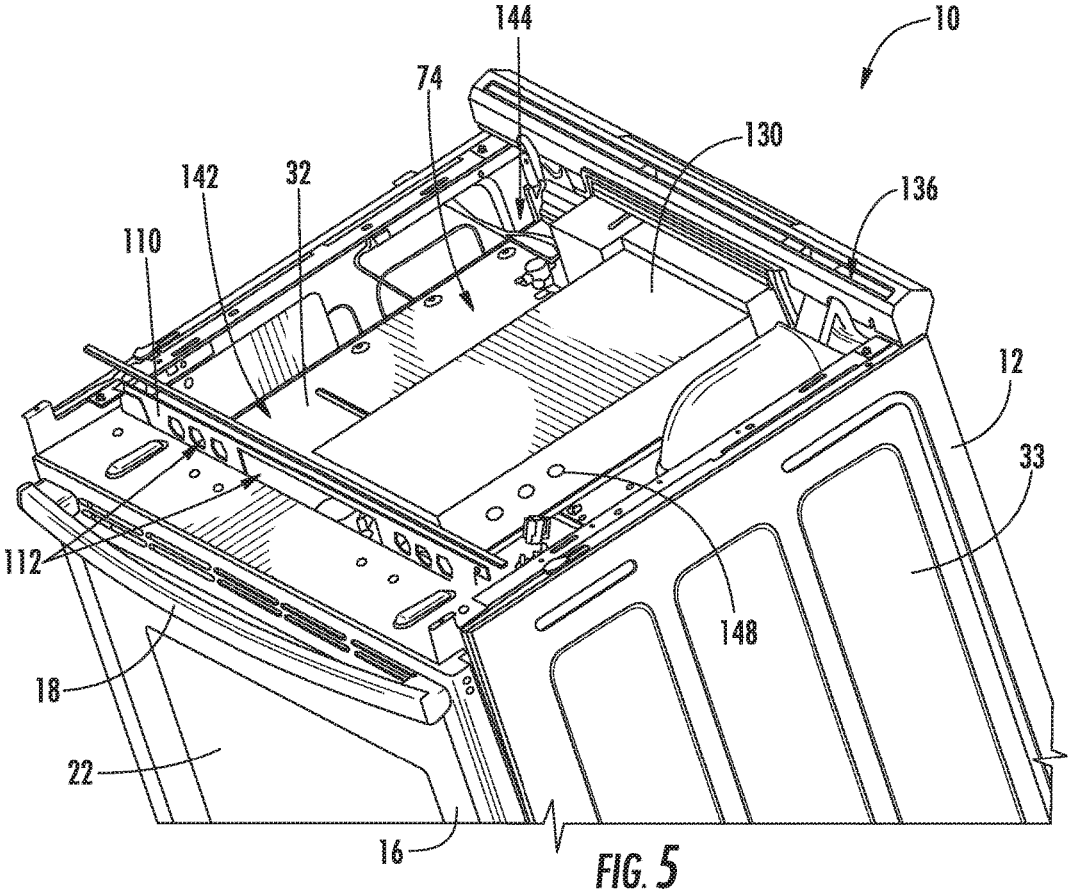
FIG. 5 provides a perspective sectional view of the exemplary oven appliance of FIG. 1 taken along the Line 5-5 of FIG. 1.

Referring now specifically to FIG. 4, various sidewalls define insulated cooking chamber 14. For example, insulated cooking chamber 14 includes a top wall 25 and a bottom wall 26 which are spaced apart along the vertical direction V. Left sidewall 27 and right sidewall 28 (as defined according to the view as shown in FIG. 1) extend between the top wall 25 and bottom wall 26, and are spaced apart along the lateral direction L. A rear wall 29 may additionally extend between the top wall 25 and bottom wall 26 as well as between the left sidewall 27 and right sidewall 28, and is spaced apart from door 16 along the transverse direction T. In this manner, when door 16 is in the closed position, a cooking cavity is defined by door 16 and top wall 25, bottom wall 26, left sidewall 27, right sidewall 28, rear wall 29, of insulated cooking chamber 14.

According to the illustrated embodiment, walls 25-29 of insulated cooking chamber 14 are depicted as simple blocks of insulating material surrounding the cooking cavity. However, one skilled in the art will appreciate that the insulating material may be constructed of one or more suitable materials and may take any suitable shape. For example, the insulating material may be encased in one or more rigid structural members, such as sheet metal panels, which provide structural rigidity and a mounting surface for attaching, for example, heating elements, temperature probes, rack sliding assemblies, and other mechanical or electronic components.

In a similar manner, cabinet 12 includes multiple panels which enclose insulated cooking chamber 14. For example, cabinet 12 includes a top panel 30 and a bottom panel 31 which are spaced apart along the vertical direction V. Left panel 32 and right panel 33 (as defined according to the view as shown in FIG. 1) extend between the top panel 30 and bottom panel 31, and are spaced apart along the lateral direction L. A rear panel 34 may additionally extend between the top panel 30 and bottom panel 31 as well as between the left panel 32 and right panel 33, and is spaced apart from door 16 along the transverse direction T. When door 16 is in the closed position, it sits flush with a front panel 35 of cabinet 12.

According to the illustrated embodiment, panels 30-35 of cabinet 12 are single ply sheet metal panels, but one skilled in the art will appreciate that any suitably rigid panel may be used while remaining within the scope of the present subject matter. For example, according to an exemplary embodiment, panels 30-35 may be constructed from a suitably rigid and thermally resistant plastic. In addition, each panel 30-35 may include multiple layers made from the same or different materials, and may be formed in any suitable shape.

Referring briefly to FIG. 4, a lower heating assembly, e.g., bake heating assembly 40, may be included in oven appliance 10, and may include one or more heating elements, e.g. bake heating elements 42. Bake heating elements 42 may be disposed within insulated cooking chamber 14, such as adjacent bottom wall 26. In exemplary embodiments as illustrated, the bake heating elements 42 are electric heating elements, as is generally understood. Alternatively, the bake heating elements 42 may be gas burners or other suitable heating elements having other suitable heating sources. Bake heating elements 42 may generally be used to heat insulated cooking chamber 14 for both cooking and cleaning of oven appliance 10.

Additionally, an upper heating assembly, e.g., broil heating assembly 46, may be included in oven appliance 10, and may include one or more upper heating elements, e.g., broil heating elements 48. Broil heating elements 48 may be disposed within insulated cooking chamber 14, such as adjacent top wall 25. In exemplary embodiments as illustrated, the broil heating elements 48 are electric heating elements, as is generally understood. Alternatively, the broil heating elements 48 may be gas burners or other suitable heating elements having other suitable heating sources. Broil heating elements 48 may additionally generally be used to heat insulated cooking chamber 14 for both cooking and cleaning of oven appliance 10.

Oven appliance 10 may also include a convection heating assembly 50. Convection heating assembly 50 may have a fan 52 and a convection heating element 54. Convection heating assembly 50 is configured for selectively urging a flow of heated air into insulated cooking chamber 14. For example, fan 52 can pull air from insulated cooking chamber 14 into convection heating assembly 50 and convection heating element 54 can heat such air. Subsequently, fan 52 can urge such heated air back into insulated cooking chamber 14. As another example, fan 52 can cycle heated air from insulated cooking chamber 14 within insulated cooking chamber 14 in order to generate forced convective air currents without use of convection heating element 54. Like heating elements 42, 48 discussed above, convection heating element 54 may be, e.g., a gas, electric, or microwave heating element or any suitable combination thereof. According to an alternative exemplary embodiment, convection heating assembly 50 need not include fan 52.

Oven appliance 10 is further equipped with a controller 58 to regulate operation of the oven appliance 10. For example, controller 58 may regulate the operation of oven appliance 10 including heating elements 42, 48, 54 (and heating assemblies 40, 46, 50 generally). Controller 58 may be in communication (via for example a suitable wired or wireless connection) with the heating elements 42, 48, 54 and other suitable components of the oven appliance 10, as discussed herein. In general, controller 58 may be operable to configure the oven appliance 10 (and various components thereof) for cooking. Such configuration may be based on a plurality of cooking factors of a selected operating cycles, sensor feedback, etc.

By way of example, controller 58 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 58 may be positioned in a variety of locations throughout oven appliance 10. In the illustrated embodiment, controller 58 may be located within a user interface panel 60 of oven appliance 10 as shown in FIG. 2. In such an embodiment, input/output ("I/O") signals may be routed between the control system and various operational components of oven appliance 10 along wiring harnesses that may be routed through cabinet 12. Typically, controller 58 is in communication with user interface panel 60 and controls 62 through which a user may select various operational features and modes and monitor progress of oven appliance 10. In one embodiment, user interface panel 60 may represent a general purpose I/O ("GPIO") device or functional block. In one embodiment, user interface panel 60 may include input components or controls 62, such as one or more of a variety of electrical, mechanical or electro-mechanical input devices including rotary dials, push buttons, and touch pads. User interface panel 60 may include a display component, such as a digital or analog display device 64 designed to provide operational feedback to a user.

User interface panel 60 may be in communication with controller 58 via one or more signal lines or shared communication busses. Controller 58 may also be communication with one or more sensors, e.g., a temperature sensor that is used to measure temperature inside insulated cooking chamber 14 and provide such measurements to controller 58. The temperature sensor may be a thermocouple, a thermistor, a resistance temperature detector, or any other device suitable for measuring the temperature within insulated cooking chamber 14. In this manner, controller 58 may selectively control heating elements 42, 48, 54 in response to user manipulation of user interface panel 60 and temperature feedback from the temperature sensor. Controller 58 can also receive temperature measurements from the temperature sensor placed within insulated cooking chamber 14 and e.g., provide a temperature indication to the user with display 64.

It should be appreciated that the invention is not limited to any particular style, model, or configuration of oven appliance 10. The exemplary embodiment depicted in the figures is for illustrative purposes only. For example, different locations may be provided for user interface panel 60, different configurations may be provided for the baking rack or ribs 24, different cooling air flow paths may be utilized, and other differences may be applied as well. In addition, oven appliance 10 may be a wall oven, an oven/range combo, a microwave oven, an electric oven, a gas oven, etc.

Referring now generally to FIGS. 2 through 6, insulated cooking chamber 14 is positioned within cabinet 12 such that walls 25-29 of insulated cooking chamber 14 and panels 30-35 of cabinet 12 define a variety of air flow passageways between insulated cooking chamber 14 and cabinet 12. These passageways, which may be referred to herein generally as air plenum 74, may generally be configured for transmitting cooling air flow throughout oven appliance 10. Air plenum 74 may generally include side air flow passageways 76 and a top air flow passageway 78 defined between panels 30-35 of cabinet 12 and walls 25-29 of insulated cooking chamber 14.

More specifically, a first side air flow passageway is disposed adjacent left sidewall 27 between left sidewall 27 and left panel 32 and a second side air flow passageway is disposed adjacent right sidewall 28 between right sidewall 28 and right panel 33. In this manner, side air flow passageways 76 may extend along the entire depth of oven appliance 10 along the transverse direction T and along the entire height of oven appliance 10 along the vertical direction V. Top air flow passageway 78 is defined generally between top wall 25 and top panel 30 (e.g., the cooktop surface in the illustrated embodiment). A variety of oven appliance 10 components, such as heating elements and other cooktop components, may be positioned within top air flow passageway 78. As illustrated in FIG. 4, top air flow passageway 78 is in fluid communication with side air flow passageway 76, such that cooling air may be drawn up side air flow passageways 76 and through top air flow passageway 78. In this manner, cooling air may be drawn under and across the various components positioned within top air flow passageway 78, thereby removing heated air and regulating component temperature.

Air may flow into side air flow passageways 76 through various apertures and/or channels defined by cabinet 12. For example, a plurality of inlet apertures 90 may be positioned along bottom panel 31 of cabinet 12. In this manner, cooler ambient air may flow into side air flow passageways 76 through inlet apertures 90. The air may then flow through air plenum 74, e.g., through side air flow passageways 76 and top air flow passageway 78 extracting heat from electronic components and other surfaces within oven appliance 10 which may be exhausted from oven appliance 10 in a manner described below. Although the illustrated exemplary embodiment includes inlet apertures 90 positioned along bottom panel 31, it should be appreciated that ambient air may enter side air flow passageways 76 through any suitable channel or pathway. For example, ambient air may enter side air flow passageways 76 through front 35 of oven appliance 10, e.g., through the lower oven drawer. Indeed, oven appliance 10 may define any suitable passageway for placing side air flow passageways 76 in fluid communication with the ambient air.

Figure 3:
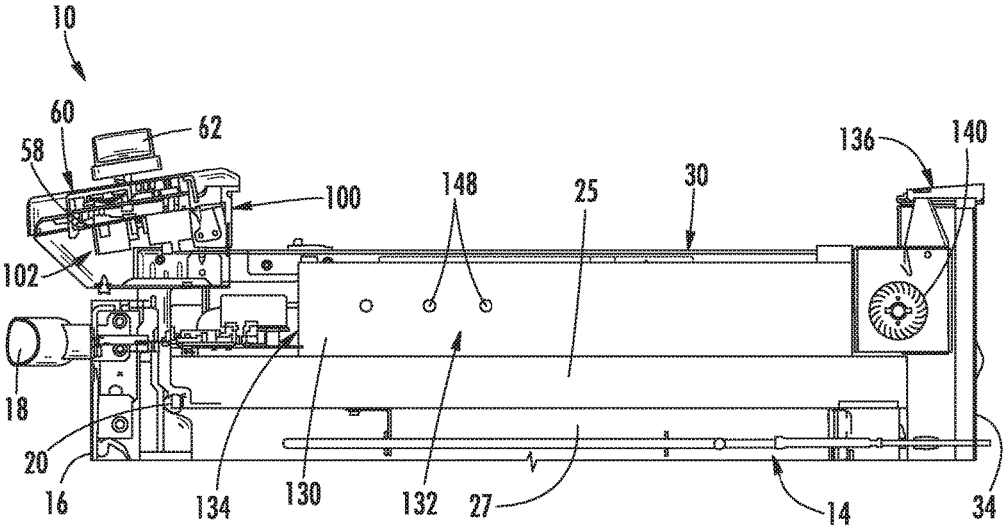
FIG. 3 provides a side sectional view of the exemplary oven appliance of FIG. 1 taken along the Line 2-2 of FIG. 1.

As shown in FIGS. 2 and 3, a control panel 100 is positioned at front 35 of cabinet 12 along the transverse direction T and adjacent top panel 30 of cabinet 12 along the vertical direction V. Control panel 100 includes user interface panel 60 and generally defines an electronics chamber 102 that is configured to receive a variety of electronic components of oven appliance 10. For example, user interface panel 60, controller 58, various regulating valves, and/or other electronic components may be positioned within electronics chamber 102.

Electronics chamber 102 generally extends along the lateral direction L between lateral sides of oven appliance 10. More specifically, electronics chamber may extend between left panel 32 and right panel 33 of cabinet 12. A back side 110 of control panel 100 may define a plurality of apertures 112 that place electronics chamber 102 in fluid communication with air plenum 74. In this manner, cooling air may flow through electronics chamber 102 to cool electronic components housed therein before being drawn out of electronics chamber 102 through apertures 112. Although apertures 112 are illustrated as one large hole flanked by six smaller holes (see FIG. 5), one skilled in the art will appreciate that any aperture having a suitable size and configuration may be used. For example, according to an alternative embodiment, a large number of small holes, one large opening, or any other suitable arrangement that places electronics chamber 102 in fluid communication with air plenum 74 may be used.

As best illustrated in FIGS. 4 through 7, electronics chamber 102 may be in fluid communication with side air flow passageways 76. More specifically, left panel 32 and right panel 33 of cabinet 12 may each define one or more openings 118 (see FIG. 7) adjacent to electronics chamber 102, such that air may flow up side air flow passageways 76, through openings 118, and into electronics chamber 102. Although openings 118 are illustrated as elongated apertures, one skilled in the art will appreciate that any suitable aperture may be used. For example, according to an alternative embodiment, a large number of small holes, one large opening, or any other suitable arrangement that places side air flow passageways 76 in fluid communication with electronics chamber 102 may be used.

According to the illustrated exemplary embodiment, oven appliance 10 further includes a duct 130 positioned on top wall 25 of insulated cooking chamber 14. Duct 130 defines an exhaust passage 132 between insulated cooking chamber 14 and cabinet 12. As illustrated, duct 130 extends along the transverse direction T between a duct inlet 134 and an exhaust port 136. Duct 130 is configured for placing air flow plenum 74 in fluid communication with exhaust passage 132 and exhaust port 136.

A fan 140 is placed within duct 130 and is configured for drawing air from air flow plenum 74 and electronics chamber 102 and discharging it out of exhaust port 136. According to the illustrated embodiment, fan 140 is a tangential fan that is positioned toward a back end of duct 130 proximate rear panel 34 of cabinet 12. However, one skilled in the art will appreciate that any other suitable fan type, position, or configuration may be used while remaining within the scope of the present subject matter. For example, fan 140 could instead be a radial fan positioned toward a front end of duct 130. Indeed, any suitable fan and duct arrangement configured for exhausting air from air flow plenum 74 and electronics chamber 102 out of exhaust port 136 may be used.

Figure 6:
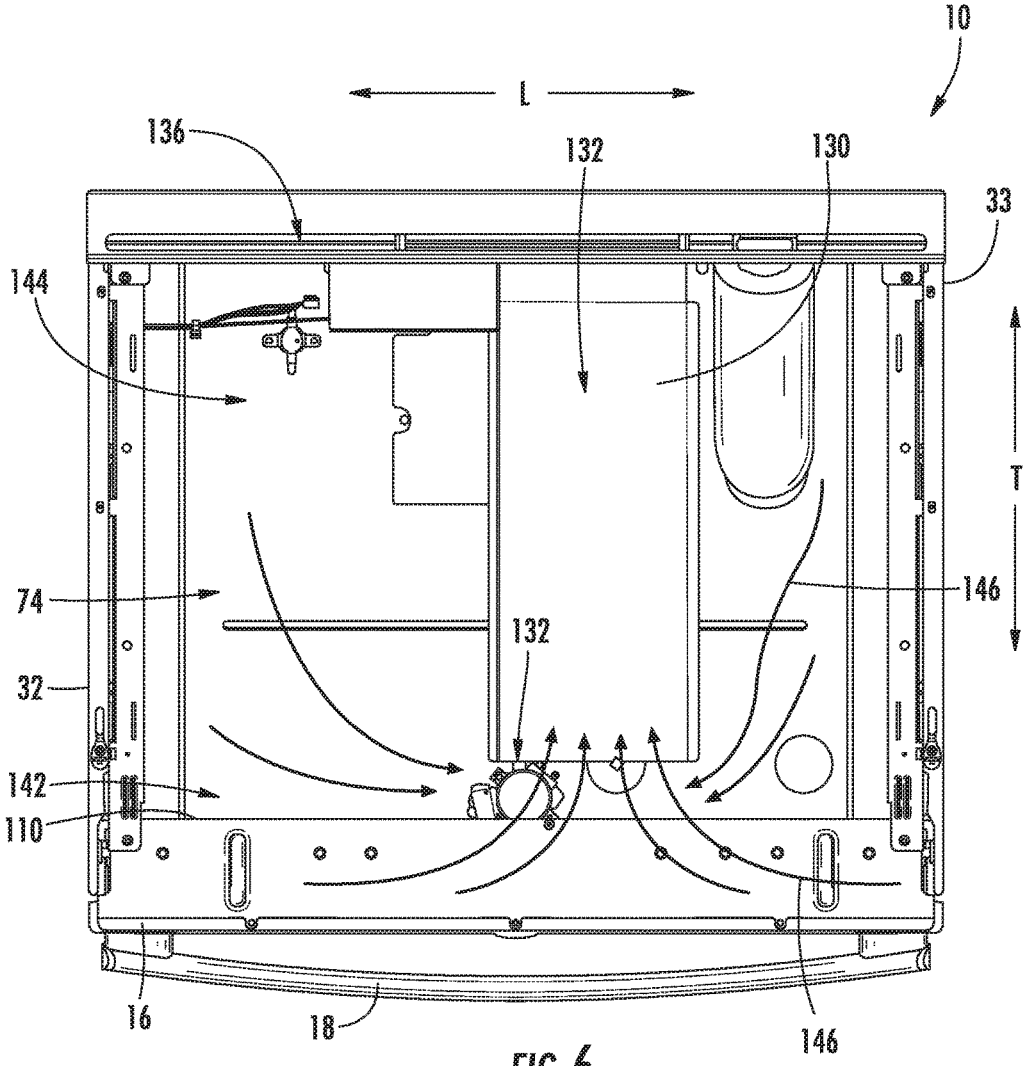
FIG. 6 provides a top sectional view of the exemplary oven appliance of FIG. 1 taken along the Line 5-5 of FIG. 1.
Figure 7:
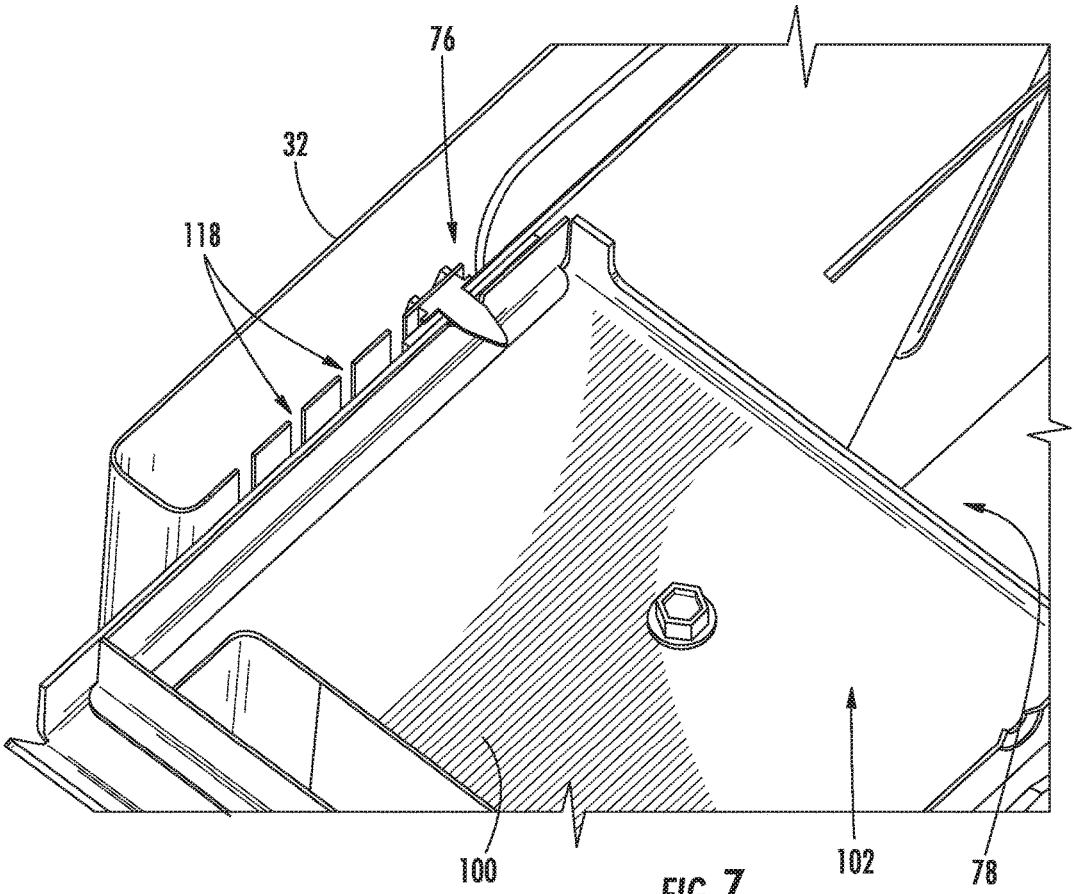
FIG. 7 provides a perspective sectional view of a plurality of openings defined adjacent a side of a control panel of the exemplary oven appliance of FIG. 1.
Figure 8:
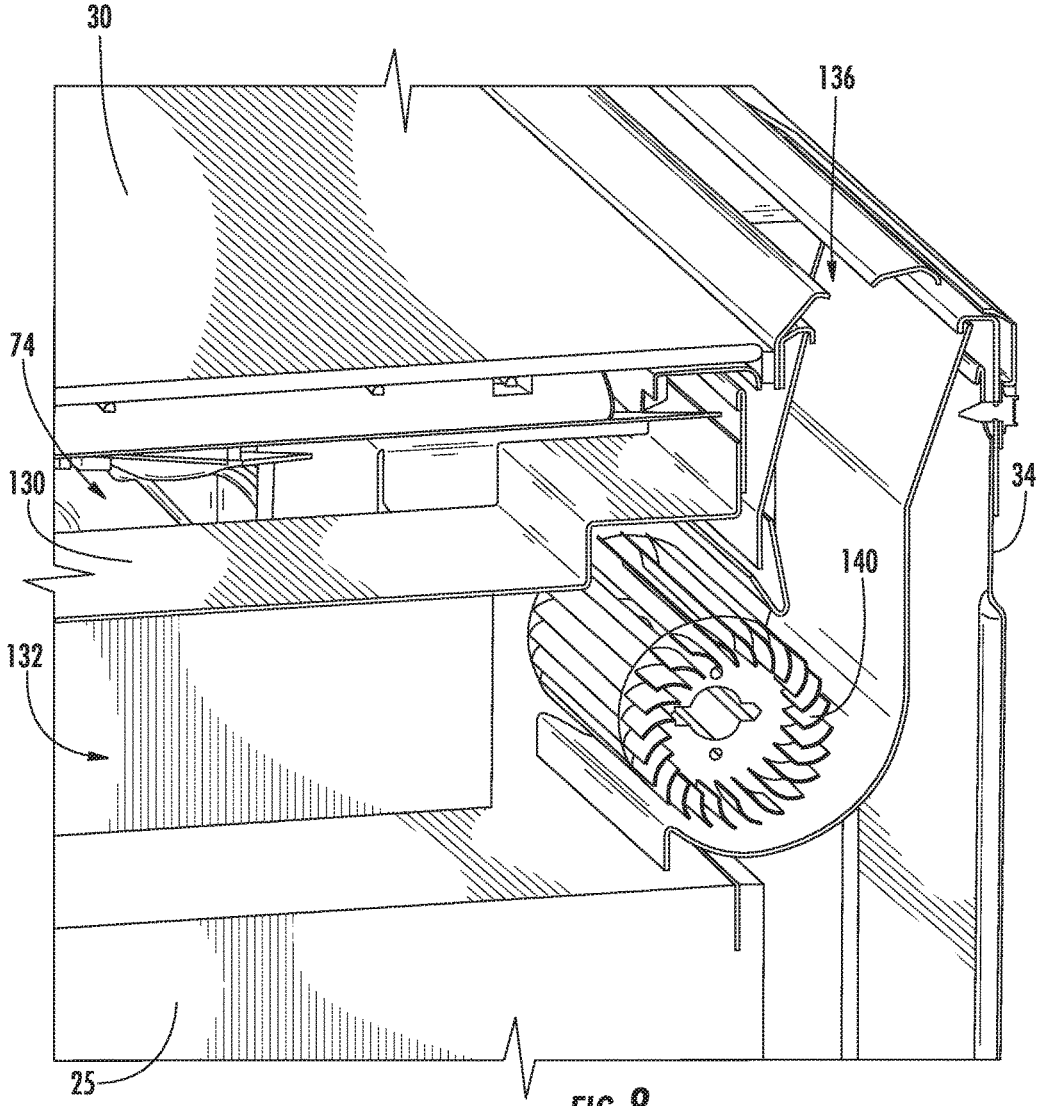
FIG. 8 provides a perspective sectional view of a tangential fan positioned within a duct and an exhaust outlet of the exemplary oven appliance of FIG. 1.

Notably, as best illustrated in FIG. 6, duct inlet 134 is positioned toward a front portion 142 of oven appliance 10, e.g., closer to control panel 100 and front 35 of cabinet than a rear portion 144 of oven appliance 10 along the transverse direction T. In this manner, fan 140 has a tendency to draw in a larger volume of air from front portion 142 of oven appliance 10, e.g., from electronics chamber 102 (as indicated by airflow arrows 146 in FIG. 6). According to one exemplary embodiment, duct inlet 134 is positioned within a front half of oven appliance 10 along the transverse direction T. According to another embodiment, duct inlet 134 is positioned in a front quarter of cabinet 102 along the transverse direction T. According to still another embodiment, duct inlet 134 may be attached to control panel 100 such that electronics chamber 102 is placed in direct, sealed fluid communication with exhaust passage 132. In such a configuration, air is drawn through inlet 134 only from electronics chamber 102 and not from elsewhere within air plenum 74, e.g., from top air flow passageway 78.

Exhaust port 136 may be positioned toward rear panel 34 of cabinet 12 and may be configured for discharging hot air from within air plenum 74, including side air flow passageways 76, top air flow passageway 78, and electronics chamber 102 out of oven appliance 10. For example, exhaust port 136 may be defined in top panel 30 of oven appliance proximate rear panel 34 of cabinet 12. By placing exhaust port 136 in a top, back corner of cabinet 102, hot air may be exhausted up and away from both oven appliance 10 and its user. Alternatively, exhaust port 136 may be defined in rear panel 34 of cabinet 12, such that it is not visible to the user, or may be positioned at any other suitable location. According to still another embodiment, exhaust port 136 may be coupled to an exhaust duct which routes heated air out of the room in which oven appliance 10 is located.

In order to adjust the relative volume of air drawn from front portion 142 of oven appliance 10 relative to rear portion 144 of oven appliance 10, duct 130 may define a plurality of apertures 148 spaced apart along the transverse direction T for placing air flow plenum 74 in fluid communication with duct 130. For example, as illustrated in the figures, apertures 148 may be evenly spaced along the length of duct 130. Alternatively, apertures 148 may be consolidated proximate areas that need additional cooling, or may be placed in any other suitable location. According to still another embodiment, duct 130 may contain no apertures 148, such that all cooling air is drawn through inlet 134.

As explained briefly above, duct 130 may be configured to draw air from desirable locations within air plenum 74, e.g., to facilitate cooling various components of oven appliance 10. Although much of air plenum 74 and its various flow passageways 76, 78 are in fluid communication with each other, positioning duct inlet 134 at a particular location within air plenum 74 or placing apertures 148 at a particular location along duct 130, fan 140 can draw a higher volume of air from those particular locations. For example, according to the illustrated embodiment, duct inlet 134 is positioned at a location proximate control panel 100, or more specifically, adjacent apertures 112 of control panel 100. In this manner, a larger air mass flow rate is drawn through electronics chamber 102 from side air flow passageways 76. Air is also drawn from elsewhere within air plenum 74, such as from top air flow passageway 78, but at a lower air mass flow rate. Thus, positioning duct inlet 134 in such a manner optimizes cooling of the components which may need cooling the most, e.g., electronic components positioned within electronics chamber 102. Similarly, more air may be drawn from side air flow passageways 76 through electronics chamber 102 than through top air flow passageway 78, thereby facilitating cooling of left panel 32 and right panel 33 of cabinet 12, particularly toward the front of oven appliance 10, where they are most likely to be touched by a user.

Although the cooling system described above includes duct 130 that is positioned on top of insulated cooking chamber 14 and extends along the transverse direction T, one skilled in the art will appreciate that this is only an exemplary embodiment used for the purpose of illustrating aspects of the present subject matter. In this regard, variations and modifications may be made to the cooling system described above while remaining within the scope of the present subject matter. For example, duct 130 may include multiple ducts extending to different locations within oven appliance and one or more fans may be used to selectively drive air in each of these ducts depending on the specific cooling needs of oven appliance 10. In addition, various partitions or other air flow passageways may be defined within oven appliance to draw cooling air through those areas that need it the most. As a result, the temperature of electronic components and cabinet surfaces may be maintained within desirable limits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A cooking appliance defining a vertical direction, a lateral direction, and a transverse direction, the cooking appliance comprising:

a cabinet;

a control panel positioned at a top, front corner of the cabinet, the control panel defining an electronics chamber;

an insulated cooking chamber positioned within the cabinet;

an air flow plenum defined between the cabinet and the insulated cooking chamber;

a duct positioned on a top of the insulated cooking chamber and extending along the transverse direction between an inlet and an exhaust port, the duct defining an exhaust passage in fluid communication with the air flow plenum and one or more apertures spaced apart along the transverse direction; and a fan positioned in fluid communication with the duct and configured for drawing air from the air flow plenum through the electronics chamber and discharging it out of the exhaust port.

2. The cooking appliance of claim 1, wherein in the inlet of the duct is positioned in a front quarter of the cabinet along the transverse direction.

3. The cooking appliance of claim 1, wherein the inlet of the duct is attached to the control panel such that the electronics chamber is placed in sealed fluid communication with the exhaust passage.

4. The cooking appliance of claim 1, wherein the air flow plenum comprises side channels positioned between lateral sides of the insulated cooking chamber and lateral sides of the cabinet along the lateral direction.

5. The cooking appliance of claim 4, wherein the control panel defines one or more openings placing the electronics chamber in fluid communication with the side channels.

6. The cooking appliance of claim 4, wherein the cabinet defines one or more inlet apertures in fluid communication with the side channels such that ambient air is drawn into the side channels.

7. The cooking appliance of claim 1, wherein the exhaust port is defined in a top of the cabinet proximate a back of the cabinet.

8. The cooking appliance of claim 1, wherein the exhaust port is defined in a back of the cabinet.

9. The cooking appliance of claim 1, wherein the one or more apertures place the air flow plenum in fluid communication with the exhaust passage.

10. The cooking appliance of claim 1, wherein the fan is a tangential fan.

11. The cooking appliance of claim 1, wherein the fan is positioned within the duct toward a back of the cabinet.

12. A cooling system for an oven appliance, the oven appliance comprising an insulated cooking chamber positioned within a cabinet, the oven appliance defining a vertical direction, a lateral direction, and a transverse direction, the cooling system comprising:

side air flow passageways positioned adjacent lateral sides of the insulated cooking chamber, the side air flow passageways being defined between the insulated cooking chamber and the cabinet;

an electronics chamber defined by a control panel of the oven appliance, the electronics chamber being in fluid communication with the side air flow passageways;

a fan positioned in fluid communication with the electronics chamber for urging air from the side air flow passageways, into the electronics chamber, through the inlet into the exhaust passage, and out of the exhaust port; and a duct extending along the transverse direction, the duct defining an exhaust passage in fluid communication with the electronics chamber and one or more apertures spaced apart along the transverse direction.

13. The cooling system of claim 12, wherein the duct extends between an inlet positioned proximate the electronics chamber and an exhaust port positioned proximate a back of the oven appliance.

14. The cooling system of claim 13, wherein in the control panel is positioned at a top, front corner of the oven appliance, and the duct inlet is positioned in a front quarter of the cabinet along the transverse direction.

15. The cooling system of claim 13, wherein the inlet of the duct is attached to the control panel such that the electronics chamber is placed in sealed fluid communication with the exhaust passage.

16. The cooling system of claim 12, wherein the cabinet defines one or more inlet apertures in fluid communication with the side air flow passageways such that ambient air is drawn into the side air flow passageways.

17. The cooling system of claim 13, wherein the exhaust port is defined in a top of the cabinet proximate a back of the cabinet.

18. The cooling system of claim 13, wherein the exhaust port is defined in a back of the cabinet.

19. The cooling system of claim 13, wherein the duct defines one or more apertures spaced apart along the transverse direction for placing the side air flow passageways in fluid communication with the exhaust passage.

20. The cooling system of claim 13, wherein the fan is a tangential fan positioned within the duct toward a back of the cabinet.

* * * * *